US005144905A

United States Patent [19]

Tanaka

[11] Patent Number: 5,144,905

[45] Date of Patent: Sep. 8, 1992

[54] DIVING BOAT

[76] Inventor: Akio Tanaka, 2174, Ao-Cho, Ono-Shi, Hyogo-Ken, Japan

[21] Appl. No.: 685,281

[22] Filed: Apr. 15, 1991

Related U.S. Application Data

[63] Continuation of Ser. No. 462,577, Jan. 25, 1989, abandoned.

[30] Foreign Application Priority Data

Jan. 25, 1989 [JP] Japan ..... 1-17047

[51] Int. Cl.[5] ..... B63G 8/22

[52] U.S. Cl. ..... 114/333; 114/312; 114/313; 114/334

[58] Field of Search ..... 114/334, 333, 312, 313, 114/314; 405/193

[56] References Cited

U.S. PATENT DOCUMENTS

| | | | |
|---|---|---|---|
| 3,251,328 | 5/1966 | Rigsby et al. | 114/334 |
| 4,109,601 | 8/1978 | Ronnevig | 114/314 |
| 4,584,960 | 4/1986 | Colling | 114/333 |
| 4,903,628 | 2/1990 | Lansford | 114/334 |

FOREIGN PATENT DOCUMENTS

| | | | |
|---|---|---|---|
| 2380941 | 10/1978 | France | 114/312 |
| 51-53600 | 12/1976 | Japan . | |
| 61-200090 | 9/1986 | Japan . | |
| 125859 | 5/1919 | United Kingdom | 114/334 |

*Primary Examiner*—Sherman D. Basinger
*Assistant Examiner*—Thomas J. Brahan
*Attorney, Agent, or Firm*—Bauer & Schaffer

[57] ABSTRACT

A diving boat wherein an air tank, water tank and navigating apparatus are provided, air within the air tank is fed into the watertight boat body and excess air produced thereby is discharged into water outside the boat body through an automatic balance type pressure regulating valve so that the air pressure within the boat body may be kept substantially the same as the water pressure outside the boat body.

3 Claims, 2 Drawing Sheets

DIVING BOAT

This is a continuation of Ser. No. 462,577 filed Jan. 25, 1989 now abandoned.

FIELD OF THE INVENTION

This invention relates to a diving boat whereby underwater sightseeings, marine sports and marine leisures can be made, fishes and shells can be caught and underwater works can be made.

BACKGROUND OF THE INVENTION

An already provided diving boat is generally designed to keep the interior of the boat body substantially under the atmospheric pressure.

In the case of diving, the water pressure outside the boat body will increase by about 1 kg/cm$^2$ per diving depth of 10m. That is to say, with the increase of the diving depth, the pressure difference between inside and outside the boat body will become larger and therefore the conventional diving boat has been required to have in the boat body a strength high enough to endure such pressure difference.

As a result, there have been problems that, when the structure is strengthened in order to obtain the required strength, the weight will increase, difficulties will be increased to transport and handle the boat, the cost will be high and it will be difficult for a general individual to purchase such diving boat.

OBJECT OF THE INVENTION

In view of the above mentioned circumstances, the present invention has it as an object to provide a diving boat which can be made light and cheap by utilizing an internal and external pressure automatically balancing system and can be easily transported and handled so that anyone may simply make underwater sightseeings and works.

SUMMARY OF THE INVENTION

The diving boat of the present invention is so formed that, in case the water pressure outside the boat body is varied by the diving depth, the air pressure within the boat body may be kept substantially the same as the water pressure outside the boat body. Therefor, a required flow volume of air is constantly fed into the boat body during diving and, on the other hand, excess air is discharged into water outside the boat body so that the air pressure within the boat body may not become too higher than the water pressure outside the boat body.

BRIEF DESCRIPTION OF THE DRAWINGS

The drawings show embodiments of the present invention.

DETAILED DESCRIPTION OF THE INVENTION

Figure 1:
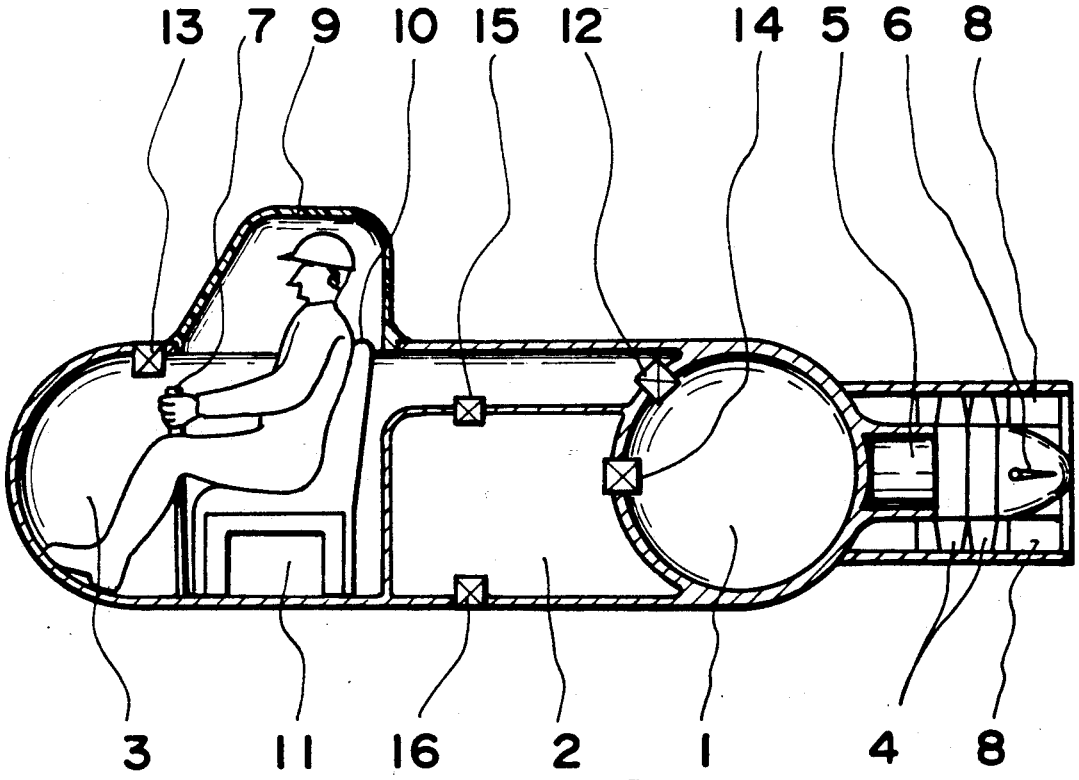
FIG. 1 is a vertically sectioned view of an embodiment.

In FIG. 1, the reference numeral 1 represents an air tank, 2 represents a water tank, 3 represents a watertight cockpit, 4 represents a screw such as of a counter propeller type driven by a motor 5, 6 represents a diving rudder operated by a steering handle 7, 8 represents a direction rudder operated by the steering handle 7, 9 represents a hatch, 10 represents a diver seat and 11 represents an electric power source battery.

In the above mentioned formation, according to the present invention, the air tank 1 is filled with compressed air, a control valve 12 is provided between the air tank 1 and cockpit 3 and an automatic balance type pressure regulating valve 13 discharging excess air within the cockpit 3 as operatively connected with the water pressure outside the boat body in case the air pressure within the cockpit 3 becomes higher than the water pressure outside the boat body is provided in the cockpit 3. Further, there are provided a control valve 14 between the above mentioned air tank 1 and water tank 2, a control valve 15 between the water tank 2 and cockpit 3 and a water feeding and discharging valve 16 on the bottom portion of the water tank 2.

There are further provided, though not illustrated, as required, an alarming apparatus alarming the occurrence of the excess of the safety diving depth limit, the drop of the battery voltage, the drop of the air tank pressure, the abnormality of the air pressure within the boat body, the entry of water into the boat body, the abnormality of the propelling apparatus or operating apparatus and other abnormal conditions, an automatic floating apparatus operating when the above mentioned alarming apparatus operates, other safety apparatus, further a rescue signal apparatus, a fresh air charging apparatus from the water surface, a lifting apparatus onto the water surface, a communicating apparatus with the water surface, a rescuing apparatus and the like.

Further, a life jacket or buoy which can be fastened to the body of the diver when seated may be fitted as a cushion to the diver seat so that, only when the cushion is fastened to the body, the diving may be started.

In the above mentioned formation, when the air contained in the air tank 1 is fed into the boat body or concretely into the cockpit 3 through the control valve 12, the air pressure within the cockpit 3 will tend to rise but the excess air within the cockpit 3 will be discharged into water above the boat body through the automatic balance type pressure regulating valve 13 as operatively responding to the water pressure outside the boat body and the air pressure within the cockpit 3 will be kept substantially the same as the water pressure outside the boat body.

The diving shall be described in the following. By utilizing that the air pressure within the cockpit 3 is substantially the same as the water pressure outside the boat body by the operation of the automatic balance type pressure regulating valve 13 but is lower than the water pressure below the boat body, while the air within the water tank 2 is being pushed out into the cockpit 3 by using the control valve 15 and water feeding and discharging valve 16, a required amount of the water below the boat body may be injected into the water tank 2.

In the above mentioned diving process, air will be fed into the cockpit 3 from the water tank 2 and further from the air tank 1 and the air pressure within the cockpit 3 will be elevated in proportion to the above mentioned diving depth but, when this air pressure becomes higher than the water pressure outside the boat body, the automatic balance type pressure regulating valve 13 will automatically open, the excess air will be discharged into water above the boat body and the air pressure within the cockpit 3 and the water pressure outside the boat body will be controlled to be substantially the same.

The case of floating up from the diving state shall be described in the following. The control valve 14 and water feeding and discharging valve 16 are opened and the compressed air from the air tank 1 is fed into the water tank 2.

The water within the water tank 2 may be discharged with the compressed air to be below the boat body through the water feeding and discharging valve 16.

As a result, the boat body will reduce in the weight and will float up.

By the way, in the above mentioned floating process, the water pressure outside the boat body will be gradually reduced to be lower than the air pressure within the cockpit 3, therefore the automatic balance type pressure regulating valve 13 will automatically open, the excess air will be discharged into water above the boat body and the air pressure within the cockpit 3 and the water pressure outside the boat body will be controlled to be substantially the same.

The advancing and retreating navigation of the diving boat is made by the screw 4 such as of a counter propeller type driven by the motor 5 and the depth and direction are changed respectively by the elevating rudder 6 and direction rudder 8 by operating the steering handle 7.

By the way, getting into and out of the boat body are made by opening and closing the hatch 9. At least this hatch 9 is made of such transparent material as an acrylate resin so that the outside of the boat may be seen by the diver as seated on the diver seat 10.

Figure 2:
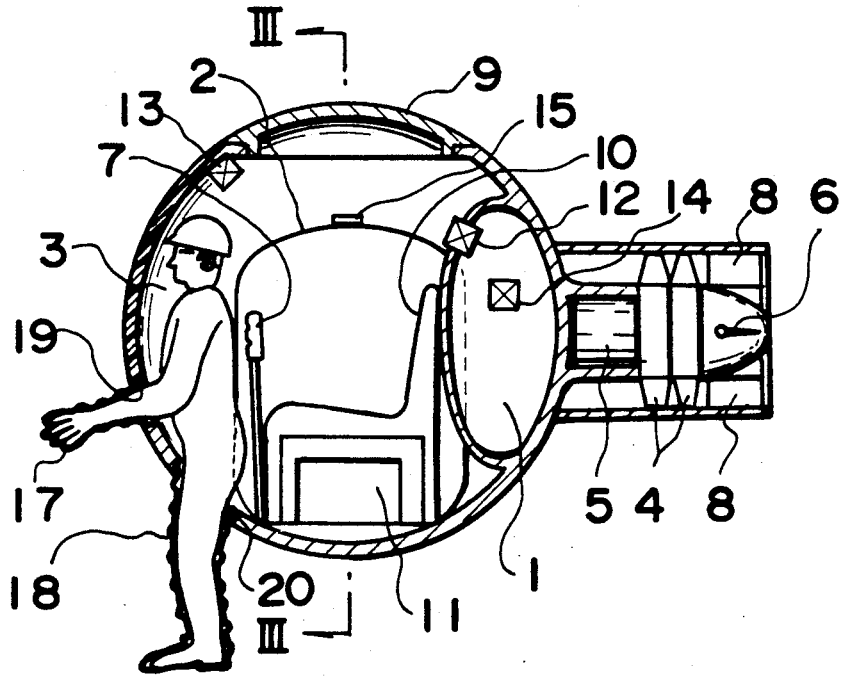
FIG. 2 is a vertically sectioned view of another embodiment.
Figure 3:
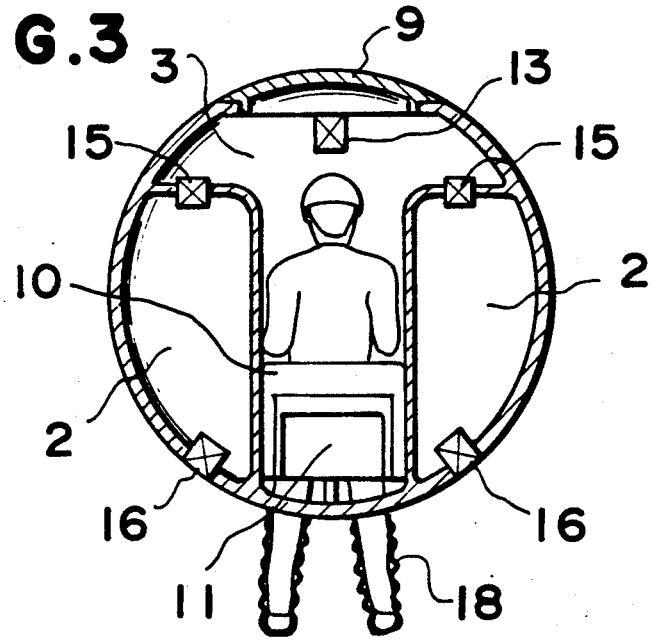
FIG. 3 is a sectioned view on line III—III in FIG. 2.

FIGS. 2 and 3 show another embodiment of a diving boat of the present invention. The same reference numerals are attached to the same parts as in the embodiment shown in the above mentioned FIG. 1. This embodiment is so formed as to be able to catch fishes and shells and to make underwater works. That is to say, as different from the embodiment in FIG. 1, the boat body is formed to be short and is provided with long gloves 17 for underwater works and boots 18 for walking in the bottom of the water. The above mentioned long gloves 17 and boots 18 are made of a rubber or the like free to stretch and retract and high in the airtightness and are airtightly fitted respectively to holes 19 and 20 provided in proper positions of the boat body. In the diving boat according to the present invention, as the pressures inside and outside the boat body are the same, there will be no pressure resistance to projecting and retracting the gloves and boots and, they are not used, they will be able to be housed within the boat body.

In this embodiment, after the boat reaches the objective bottom of the water by the above described diving, advance and retreat, when the operation of the boat body is stopped and, as shown in FIG. 2, both hands and both legs are put respectively into the long gloves 17 and boots 18 and are projected out of the boat body, a bottom walking and underwater work will be able to be made.

By the way, in case a fishing tool or working tool is further required, it may be prepared in advance in a proper position outside the boat body.

As explained above, in the present invention, such large effects as are in the following can be expected:

(1) In the diving boat of the present invention, as compared with a conventional atmospheric pressure type, the required strength of the boat body theroretically reduces as follows:

| Diving depth: | Required strength: |
|---|---|
| 5 m type | 20% |
| 10 m type | 10% |
| 15 m type | 7% |
| 20 m type | 5% |
| 30 m type | 3% |
| 50 m type | 2% |
| 100 m type | 1% |

(The above mentioned Required strength is a ratio of the required strength of the diving boat of the present invention in case the required strength of the conventional type when the pressure within the boat body is always 1 $kg/cm^2$ (atmospheric pressure) is 100% and the pressure difference between inside and outside the boat body of the present invention is always 0.1 $kg/cm^2$.)

As mentioned above, the larger the diving depth, the more predominantly advantageous the present invention.

(2) In case the material of the boat body is made the same as of the conventional type, the weitht of the boat body according to the present invention will become light in proportion to the required strength in the above mentioned paragraph (1).

(3) In case the thickness of the boat body wall is made the same as of the conventional type, the required material strength of the boat body according to the present invention may be lessened in proportion to the required strength in the above mentioned paragraph (1).

Therefore, a plastic material weaker and lighter than a metal material can be used. The hatch made of an acrylate resin and explained in the embodiment of the present invention is an example of this. Also, such material as rubber high in the softness and elongation can be utilized as a member forming a part of the boat body without being reinforced and therefore the form structure which has been impossible conventionally can be easily realized.

The long gloves and boots made of rubber or the like and explained in the embodiment of the present invention are examples of this.

(4) In the diving boat of the present invention, to keep the pressure difference between inside and outside the boat body so slight, fresh air is fed from the air tank to the cockpit and old dirty air discharged out of the boat. Therefore, air to be breathed by the diver will be refreshed and an expensive air refreshing apparatus and air cleaning apparatus will not be required to be set in the diving boat which will be economical.

As apparent from the explanation of the embodiments and the various effects in the above mentioned paragraphs (1) to (4), in the present invention, the diving boat can be epochally reduced in the weight, can be made small and simple, can be easily worked and can be made of a light cheap plastic material or the like so that an unprecedented new type diving boat may be provided at a low cost.

What is claimed is:

1. A fully submersible boat for operation under water comprising a hull having internal partitions dividing said hull into a plurality of air tight and water compartments including a cockpit, a first tank containing a source of air under pressure, and a second tank containing water and air, first unidirectional valve means for feeding air from said first tank into said cockpit, second unidirectional valve means for transferring air between said first and second tanks, third unidirectional valve means for feeding air from said second tank into said cockpit, bidirectional valve means for introducing water into said second tank to cause air to be fed into said cockpit from said second tank and to expel water from said second tank, and automatic relief valve means responsive to a relatively higher air pressure in the cockpit than the pressure of the water exterior of said boat to cause the discharge of excess air from said hull into the water.

2. A fully submersible boat for operation under water comprising a hull having internal partitions dividing said hull into a plurality of air tight and water compartments including a cockpit having the operator of said boat, a first tank containing a source of air under pressure, and a second tank containing water and air; unidirectional valve means for feeding air from said first tank into said cockpit, second unidirectional valve means for transferring air between said first and second tanks and means for feeding air from said second tank into said cockpit; and bidirectional valve means for introducing water into said second tank to cause air to be fed into said cockpit from said second tank and to expel water from said second tank, and automatic relief valve means responsive to a relatively higher air pressure in the cockpit than the pressure of the water exterior of said boat to cause the discharge of excess air from said hull into the water, wherein said cockpit is provided with at least one set of boots and elongated gloves, said hull being provided with openings into said cockpit with which said gloves and boots are integrally attached and rendered watertight, said gloves and boots being adapted for selective extension outwardly from said hull into the water exterior of said boat to permit wearing by a human operator within the cockpit and for retraction into said cockpit when not so worn.

3. The submersible boat according to claim 2, wherein said cockpit is spherical and said second tank is formed into two parts straddling the location of said boots and gloves.

* * * * *